United States Patent [19]

Switall

[11] Patent Number: 4,603,655

[45] Date of Patent: Aug. 5, 1986

[54] LIQUID APPLICATOR FOR A PRINTING PRESS

[75] Inventor: Thomas G. Switall, Wheeling, Ill.

[73] Assignee: Ryco Graphic Manufacturing, Inc., Wheeling, Ill.

[21] Appl. No.: 733,386

[22] Filed: May 13, 1985

[51] Int. Cl.[4] ..... B05B 15/02

[52] U.S. Cl. ..... 118/302; 239/112; 118/315

[58] Field of Search ..... 118/302, 315; 239/112, 239/394, 436, 288.5, 288.3, 288

[56] References Cited

U.S. PATENT DOCUMENTS

| | | | |
|---|---|---|---|
| 3,215,350 | 11/1965 | Hetrick | 239/288.5 |
| 3,674,205 | 7/1972 | Kock | 239/112 X |
| 4,262,848 | 4/1981 | Chabria | 239/112 |
| 4,365,585 | 12/1982 | Naylor et al. | 239/112 X |

*Primary Examiner*—Shrive P. Beck

*Attorney, Agent, or Firm*—Lee, Smith & Zickert

[57] ABSTRACT

The disclosed applicator applies liquids such as glue or a backbone softening liquid to a web of paper as that paper is moving through a printing press. The applicator has a long, thin dispensing tube, a liquid supply line and a gas purge line. Means is provided for a selectively and alternatively connecting the liquid supply line and the gas purge line to the dispensing tip so that when the liquid supply line is connected, the tip will dispense liquid and when the gas purge line is connected, the tip will be purged of liquid. A shield is provided which at least partially surrounds the tip when the tip is connected to the gas purge line so that the tip will be protected when it is not in use and workers will be protected from the tip as it is being purged.

7 Claims, 4 Drawing Figures

FIG. 1
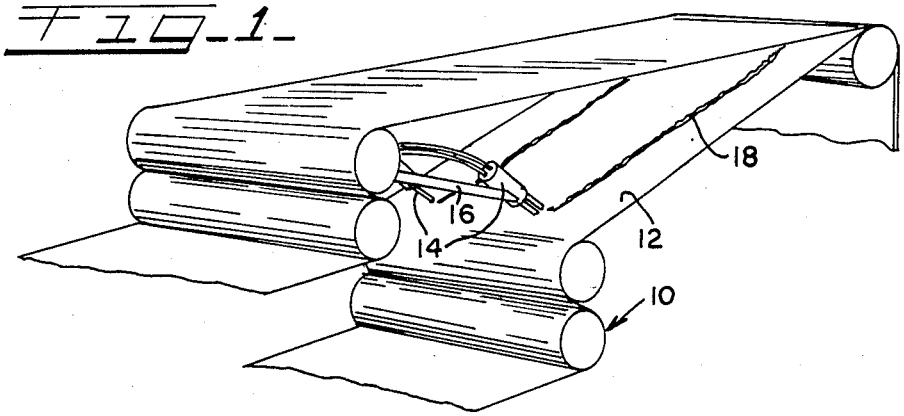
FIG. 2
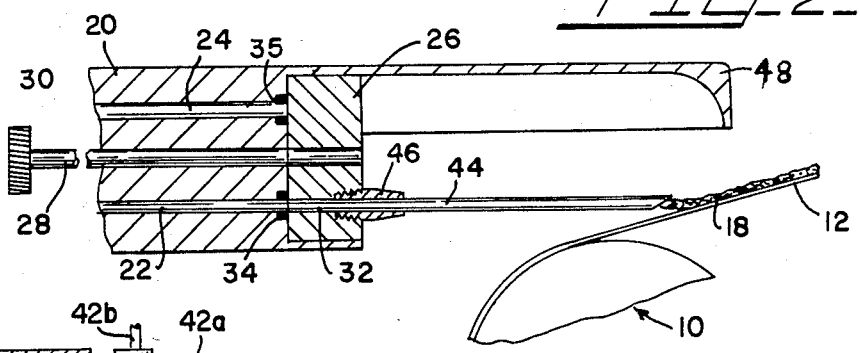
FIG. 3
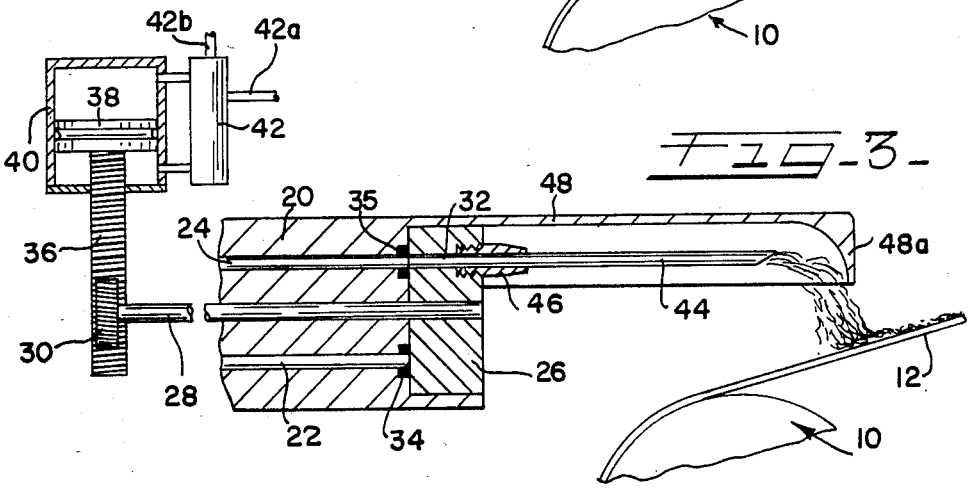
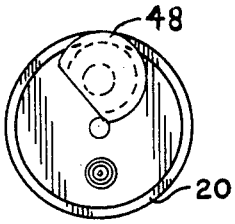
FIG. 4

LIQUID APPLICATOR FOR A PRINTING PRESS

BACKGROUND AND SUMMARY OF THE INVENTION

This invention relates to a system for applying a liquid, such as glue, in a thin stream onto a web of paper as it is moving through a printing press. The system provides a mechanism for purging the liquid from the applicator after each application to prevent clogging of the applicator.

There are presently on the market systems which apply a thin stream of glue or paste, or backbone softening liquid to a web of paper as it is moving through the press. The applicator is usually positioned immediately ahead of the folding mechanism which folds the web into the configuration desired so that the portions of the web are glued together. The type of systems presently on the market utilize applicators which resemble hypodermic needles to apply the liquid paste or glue. When the application is completed, the applicator has to be quickly disassembled and purged otherwise the glue will solidify in the fine conduit, causing cleaning problems and possibly replacement of the needle-like applicator.

This can be a considerable problem because it may be necessary on occasions to shut down the press in the middle of the application, and if the press is off for any length of time, the glue may thicken or solidify in the applicator.

It is an object of this invention to provide a means for readily purging the applicator whenever the applicator is not being used so that the liquid will not remain in the applicator and will not tend to thicken or dry and clog the applicator. With this system, the applicator is always clean and ready for use.

The system not only provides for purging of the applicator, but it provides the purging in a novel and safe manner which will protect the press operator from being injured by the needle-like applicator and also it provides a shielding for the rather fragile applicator tip so that it will not be damaged while the applicator is in use.

In accordance with this invention, an applicator is provided for applying a liquid such as a glue or backbone softening liquid to a web of paper so that web is moving through a printing press. The applicator comprises along, thin needle-like dispensing tip, a liquid supply line, a gas purge line and means for alternately connecting the liquid supply line and the gas purge line to the dispensing tip. When the liquid supply line is connected to the tip, the tip will be arranged to dispense liquid and when the gas purge line is connected, the tip will be purged of the liquid. A shield means is provided to at least partially surround the tip when the tip is connected to the gas purge line.

The applicator has a body member having first and second fluid conduits extending therethrough for connecting to the separate gas and liquid sources. A head member is mounted for movement relative to the body. This head member is preferably journaled for rotation relative to the body, and the head member has a fluid conduit therethrough which is aligned with the first fluid conduit in the body member in a first relative position of the members and is aligned with the second fluid conduit in the body member in a second relative position of the members. The fluid dispensing tip is mounted on the head member, and means is provided for effecting movement of the members between their first and second relative positions, so that in the first position fluid may be discharged from the tip and in second position the tip may be purged of the liquid.

The shield may be mounted on the body member, which is preferably stationary, and this shield extends over and in front of the dispensing tip when the tip has been moved to its position in fluid communication with the purge line. The tip preferably extends parallel to the axis of rotation of the head and the shield extends parallel to the tip so that when the tip is rotated to its purging position, it will be substantially contained within and protected by the shield.

BRIEF DESCRIPTION OF THE DRAWINGS

In FIG. 1 there is shown portions of a printing press with a pair of applicators constructed in accordance with this invention applying glue in a thin stream to a web of paper as it is moving through the printing press.

FIG. 2 is an enlarged side sectional elevational view of portions of an applicator constructed in accordance with the invention, the tip of the applicator being in position to apply a stream of glue to the web of paper moving through the press.

FIG. 3 is a side sectional elevational view of portion of the applicator, showing the tip having been moved to the purge position to purge the tip of liquid, and showing schematically the mechanism for effecting movement of the head member and tip relative to the body member.

FIG. 4 is an end elevational of the applicator in its purge position.

DETAILED DESCRIPTION OF THE PREFERRED EMBODIMENT

In FIG. 1 there is shown a portion of a printing press 10 which may be the portion of the press which folds the printed paper 12 as it is exiting from the press. A pair of applicators 14 are mounted in fixed position relative to the press by means of a support 16. The applicators 14 are adapted to apply a thin stream of liquid 18 to the surface of the paper as the paper is moving through the press. The liquid 18 may be a paste or glue or it may be a softening solution which permits more precise tighter folds and eliminates backbone cracking in bound printed volumes. While the invention has application to any types of liquid which may be deposited in a narrow ribbon or line on the surface of the paper, it has particular application to glue or paste which tends to dry and clog the relatively small apertured applicator.

The details of the applicator are best illustrated in FIGS. 2 and 3. The applicator 14 has a body member 20 through which there extends a liquid conduit 22 and a gas or air purge conduit 24. The liquid conduit 22 is connected by suitable fluid connections and tubing to a liquid supply such as a supply of glue or paste, and the air purge conduit 24 is connected by suitable connectors and tubing to an air supply which is preferably of the type which delivers a short pulse of air.

A head member 26 is mounted for movement relative to the body member 20 at the forward end of the body member. In a preferred embodiment, the head member 26 is mounted on a shaft 28 which is journaled for rotation along the central axis of the body member 20. The rearward end of the shaft 28 extends rearwardly of the body member 20, and carried on the rearward end of this shaft 28 is a gear 30. As shown in FIGS. 2 and 3, the head member 26 rotates about a horizontal axis.

The head member 26 has a fluid conduit 32 extending therethrough which in one position of relative adjustment with respect to the fixed body member 20 aligns with the liquid or glue conduit 22 member (as illustrated in FIG. 2), and in the other position of adjustment, the conduit 32 in the head member 26 aligns with the air purge conduit 24 of the body (as illustrated in FIG. 3). Resilient O-ring seals 34 and 35 are provided in the recessed forward face of the body member 20 surrounding the conduits 22 and 24, respectively. These seals provide a fluid-tight seal between the moveable head member 26 and the fixed body member 20.

There are various ways of moving the head member 26 relative to the body member 20. One such means is schematically illustrated in FIG. 3 wherein a rack 36 is attached to the movable piston 38 of an air cylinder 40. A solenoid operated air control valve 42, having a pressurized air line 42*a* and an exhaust line 42*b*, selectively directs air at the top or the bottom of the piston 38 forcing the piston down or up as the case may be. Movement of the piston 38 will cause the rack attached to the piston to move up and down, and the rack 36 is in operating in engagement with the pinion or gear 30 attached to the shaft 28 on which the head member 26 is mounted. On the down stroke of the piston (illustrated in FIG. 3), the head member 26 will be rotated to the position to align the conduit 32 in the head member with the air purge conduit 24, and in the up stroke of the piston 38, the conduit 32 in the head member 26 will be aligned with the glue conduit 22 in the head member 20, as illustrated in FIG. 2.

Attached to the forward end of the moveable head member 26 is a tip 44 having a threaded connector 46 at its rearward end which is threaded into the head member 26 and places the tip 44 in fluid communication with the conduit 32. The constriction of the tip 44 is similar to that of a hypodermic needle, having a very thin bore which may be substantially smaller than the bore of the conduits 22 and 24 in the body member 20 and the conduit 32 in the head member 26. The tip thus tends to easily clog if the material dries within it, and thus it is highly desirable to purge the tip with a blast of air from the air purge conduit 24 after each glue application. In order to do this, the needle-like tip 44 is moved from the position adjacent the paper 12 to an elevated position illustrated in FIG. 3. It is preferred that in this position the tip be protected from damage and also that the operator of the press be protected from the relatively sharp tip, particularly when the air is being forced through the tip. To accomplish this, a shield 48 is affixed to the body member 20 and extends forwardly of the body member in substantially parallel relationship with respect to the axis of rotation of the head member 26. The shield member has a generally cylindrical outer configuration and is open at one side to receive the tip 44 as it is rotated into the position within the shield in alignment with the air purge conduit 24. The forward end of the shield 48*a* extends downwardly to cover the front portion of the tip in its purge position illustrated in FIG. 3. Thus the shield at least partially surrounds the tip when the tip is in its purge position, protecting the tip and the press operator from one another.

It may be thus be seen that an applicator is provided for applying liquids such as glue to a web of paper moving through the printing press. The needle-like tip of the applicator is purged of the liquid so that the thin tip will always be clean and ready for use, thus eliminating substantial down time and cleaning of the tip. The shield protects the tip when it is out of use and protects the operator of the press from the tip, particularly when it is being purged by a blast of air. The shield could have any hollow configuration which would permit it to surround and protect the tip.

Various modifications may be made in the illustrated embodiment without departing from the spirit and scope of the invention. For example, the movement of the head member 26 may be linear and the head member may be moved by means of a rotary solenoid or even a linearly acting solenoid.

What is claimed is:

1. An applicator for applying liquid such as glue to a web of paper as it is moving through a printing press, said applicator comprising a body member having separate first and second fluid conduits extending therethrough for connecting to separate liquid and purge fluid sources, a head member mounted for movement relative to said body member, said head member having a fluid conduit therethrough aligned with the first fluid conduit in said body member in a first relative position of said members and aligned with the second fluid conduit in said body member in the second relative position of said members, a fluid dispensing tip mounted on said head member in fluid communication with the fluid conduit through said head member such that when said members are in said first relative position, the outer end of said tip will be positionied in close proximity to the surface of said web of paper, and when said members are in said second relative position, the outer end of said tip will be positioned remote from the surface of the web of paper, and means for effecting movement of said members between said first and second relative positions, whereby said tip may selectively apply liquid to the paper or be purged of liquid remote from the paper.

2. An applicator for applying liquid such as glue to a web of paper as it is moving through a printing press, said applicator comprising a body member having separate first and second fluid conduits extending therethrough for connecting to separate first and second fluid sources, a head member mounted for movement relative to said body member, said head member having a fluid conduit therethrough aligned with the first fluid conduit in said body member in a first relative position of said members and aligned with the second fluid conduit in said body member in the second relative position of said members, a fluid dispensing tip comprising a long, narrow tube mounted on and extending forwardly from said head member in fluid communication with the fluid conduit through said head member, a shield carried by said body member and extending over and in front of the dispensing tip when the members are in their second relative position, and means for effecting movement of said members between said first and second relative positions, whereby the fluid passing through said tip may be selectively changed.

3. The structure of claim 1 wherein said body member and said shield are mounted in fixed position and said head member is movable between said first and second positions.

4. The structure of claim 3 wherein said head member is rotatable relative to said body member, and said tip extends outwardly from said head member in substantially parallel relationship with respect to the axis of rotation of said head member.

5. The structure of claim 4 wherein said shield extends outwardly from said body member in substantially parallel relationship with respect to the axis of rotation of said head member.

6. The structure of claim 5 wherein said shield is a hollow body, open at one side to receive the tip as it is rotated into position within the shield, whereby the tip will be substantially covered during purging.

7. An applicator for applying liquid, such as glue, to a web of paper as it is moving through a printing press, said applicator comprising a long, thin dispensing tip, a liquid supply line, gas purge line, means selectively and alternatively connecting said liquid supply line and said gas purge line to said dispensing tip, whereby when said liquid supply line is connected to said tip, the tip will dispense liquid and when said gas purge line is connected to said tip, the tip will be purged of liquid, and shield means at least partially surrounding said tip when said tip is connected to said gas purge line.

* * * * *